US008109806B2

(12) United States Patent
Bodnar

(10) Patent No.: US 8,109,806 B2
(45) Date of Patent: Feb. 7, 2012

(54) EMERGENCY BRA MASK

(76) Inventor: Elena Bodnar, Chicago, IL (US)

( * ) Notice: Subject to any disclaimer, the term of this patent is extended or adjusted under 35 U.S.C. 154(b) by 0 days.

(21) Appl. No.: 12/582,674

(22) Filed: Oct. 20, 2009

(65) Prior Publication Data

US 2011/0092135 A1 Apr. 21, 2011

(51) Int. Cl.
*A41C 3/00* (2006.01)

(52) U.S. Cl. ..... 450/86; 450/36; 450/54

(58) Field of Classification Search ..... 2/4, 9, 51, 2/46; 450/36–39, 54–58, 86, 88, 1; 128/206.19, 128/206.17, 206.12, 206.21
See application file for complete search history.

(56) References Cited

U.S. PATENT DOCUMENTS 5,927,280 A * 7/1999 Miyake ..... 128/857
7,255,627 B2 * 8/2007 Bodnar et al. ..... 450/1
7,836,887 B1 * 11/2010 Kling ..... 128/206.16

* cited by examiner

*Primary Examiner* — Gloria Hale
(74) *Attorney, Agent, or Firm* — Eli Weiss, Esq

(57) ABSTRACT

A bra that is adapted to be a face mask has first and second bra cups, each of which includes an air filter and which are removably coupled to each other with a first attachment member. A formable member is incorporated into the upper rim of each bra cup as a structural element of the bra. A first body strap is coupled to the first bra cup and a second body strap is coupled to the second bra cup. A second attachment member removably couples ends of the first and second body straps together. When the bra is used as a face mask, first and second body straps are separated and the second attachment member couples the first body strap to the first bra cup via the first attachment member as the first bra cup is separated from the second bra cup.

5 Claims, 3 Drawing Sheets

EMERGENCY BRA MASK

BACKGROUND OF THE INVENTION

1. Field of the Invention

The present invention relates generally to an article of clothing that can be used as an air filter and, more specifically to a bra which is normally used as an every day article of attire by women which can be used in an emergency as a face mask to filter contaminated air.

2. Description of Related Art

At the present time terrorists are increasing their activities in many countries of the world. The attacks can be in the form of explosive devices and/or gas. One such attack was the use of gas in the Japanese underground rail system. Another attack was the use of explosives on the rail system in the United Kingdom. Still another terrorist attack that produced large amounts of contaminated air over a vast area was the attack on the World Trade Center in New York City.

In the attack on the World Trade Center, two buildings, each over 100 floors, collapsed creating a huge dust cloud that quickly spread over a large area and contained many different undesirable and harmful contaminates such as asbestos, soot, smoke, vapors of various chemicals, and the like.

During the World Trade Center attack people tried to cover their faces with handkerchiefs or they tried to enter local stores to avoid breathing the contaminated air.

An item of use that could have been used as a face mask to cover the mouth and nose of a person to prevent a user from breathing contaminated air during these attacks could have been the cup of a bra. Most women prefer to have some sort of breast support during the day regardless of whether the type of dress is casual, semi-formal, sporty, etc.

An example of a bra that can be used as a face mask is shown in U.S. Pat. No. 7,255,627 to Bodnar which discloses a garment device convertible to one or more facemasks wherein the garment device has a plurality of detachable cup sections. Each of the cup sections has a filter device, an inner portion which is positioned adjacent to the inner area of the user's chest, and an outer portion which is positioned adjacent to the outer area of the user's chest. The garment device has at least one securing device detachably coupling the inner portions of the cup sections to one another, and the garment device also has at least one other securing device attached to the outer portion of at least one of the cup sections. The other securing device is operable to: detachably couple the outer portions of the cup regions to one another and to each one of the cup sections, attach the outer portion of said cup region to the inner portion of said cup region after said cup region is detached from the other cup region, thereby converting the bra cup to a plurality of facemasks.

A problem that has not been addressed with the above mentioned patent is the air leakage that is present in the nasal area. The masks must accommodate a wide variety of facial sizes and configurations and, therefore, the periphery of the mask does not always tightly engage and seal against the bridge of the user's nose. Consequently, the wearer can be exposed to contaminated air that leaks between the periphery of the mask and the face.

What is needed is a bra that can be converted into a simple respiratory face mask, particularly with respect to a relatively simple yet highly effective face mask construction which is easy to carry in an inconspicuous way, is always available and ready for use in almost any emergency, can substantially reduce the inhalation of contaminated air and/or gases, and can alert the user of exposure to radioactive particles and/or chemical contaminants.

SUMMARY OF THE INVENTION

In an exemplary embodiment of the present invention, there is disclosed a bra that is adapted to be a face mask which has first and second bra cups, each of which include an air filter and are removably coupled to each other with a first attachment means. A formable member is coupled to the air filter of each bra cup. One end of a first body strap is coupled to the first bra cup and one end of a second body strap is coupled to the second bra cup. A second attachment means removably couples the second ends of the first and second body straps together. When the bra is to be used as a face mask, the first and second body straps are separated and the second attachment means is used to couple the first body strap to the first bra cup via the first attachment means as the first bra cup is separated from the second bra cup. When the bra cup is used as a face mask, the formable is located over the user's nose bridge area and can be bent into a U shape to provide two or more leg portions which extend along and press on both sides of the user's nose to provide a more effective seal between the user and the face mask.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
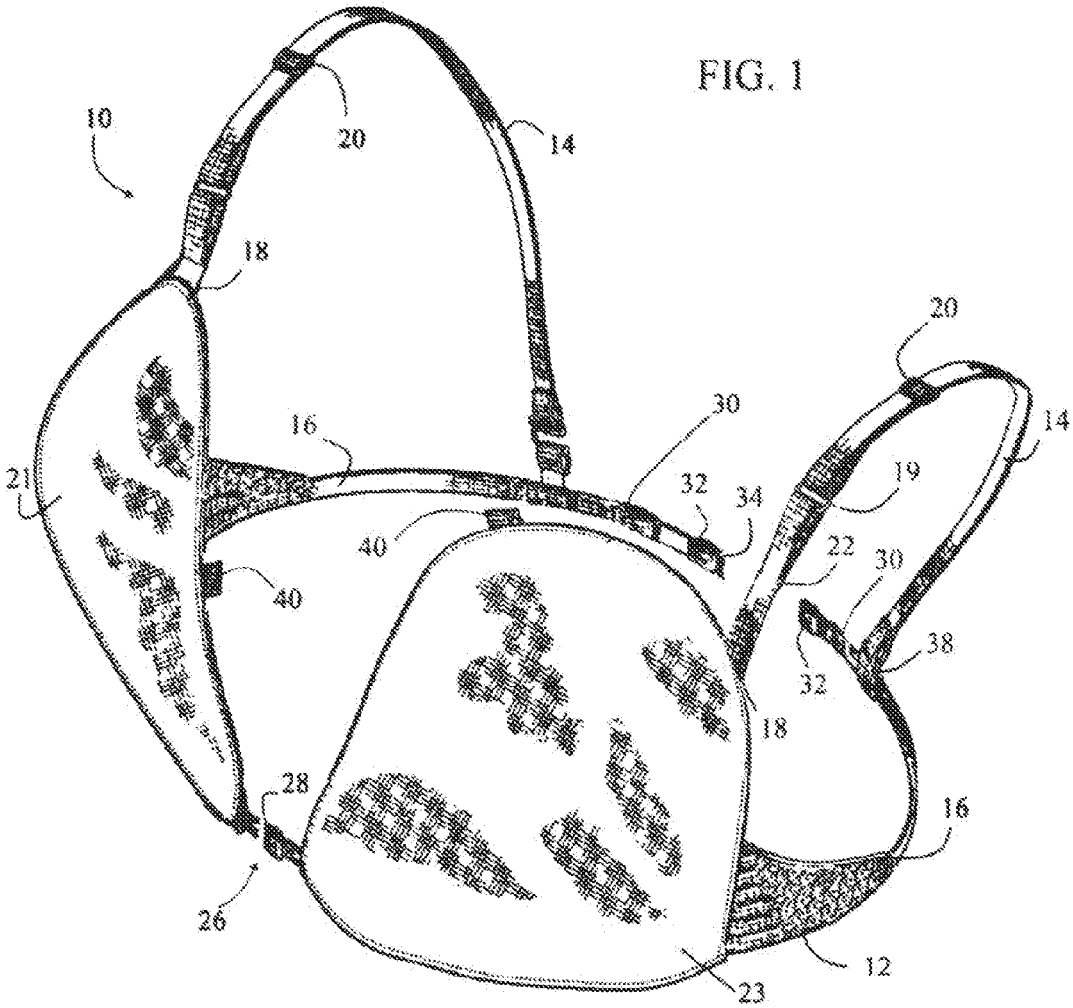
FIG. 1 is a perspective view of a bra with straps where each breast cup of the bra can be used as a face mask in accordance with the principles of the invention.

Referring to FIG. 1, there is shown a perspective view of a bra with straps where each breast cup 21, 23 of the bra can be used as a face mask in accordance with the principles of the invention. The bra, generally indicated at 10, includes a thin body portion 12, shoulder straps 14 which are connected to the top edge 18 of a cup typically by being sewn or stitched thereto. Each shoulder strap 14 typically includes a strap adjustment member, which is shown as a thin slide fastening member 20. Conventionally, the bra straps 14 are formed of an elastic material 22 that extends at least partially along the length of the strap 14, the remaining portion of the strap 14 can be a blend of a natural or synthetic material and an elastic portion 22. The elastic portion 22 is interconnected at one end with the bra body strap 16 and at the other end with the remaining portion of the strap by means of clip, loop or other attachment means 19. The body strap 16 is provided with a suitable buckle or other type of friction device 30 and an adjustable looped portion 32. The actual loop end 32 of the strap 16 in turn is suitably secured to the connector 34, such as by stitching. With such an arrangement, the size of the body strap 16 can be adjusted to be anywhere from about full length to half-length.

It is desirable that the straps are visually unobtrusive when worn under outerwear. The shoulder straps 14 can be formed such that they are not entirely elastic along a portion of the strap, but rather are formed of the same material or fabric along its entire length. Accordingly, any desired fabric or blend of fabric, or even different fabrics for different portions, can be used for the straps 14, but preferably, no portion of the strap 14 should be formed entirely of an elastic material.

The bra cups 21 and 23 are joined together at 26 with a suitable front closure 28, such as a separable fastener or clasp. Any suitable closure may be employed provided the closure is relatively flat, and is of the type which enables the joining of the bra cups in a desired spaced relationship. The closure should also be of a suitable material, such as plastic or metal, and be capable of repeated use.

The body and shoulder straps are all preferably made of an elastic material which can stretch along the length of the strap. A band (not shown) that is located under each bra cup should also be stretchable and be of the same material as the body and shoulder straps.

The materials or fabrics used for making the cups and thin body portions 12 may be conventional materials, such as cotton, rayon, silk, polyesters, nylon, satin, etc., and such materials may exhibit numerous characteristics, such as stretch along one or more directions, softness and/or smoothness, transparency, or other particular properties one of which must be the ability to filter air which passes through the fabric of the bra cup.

Figure 2:
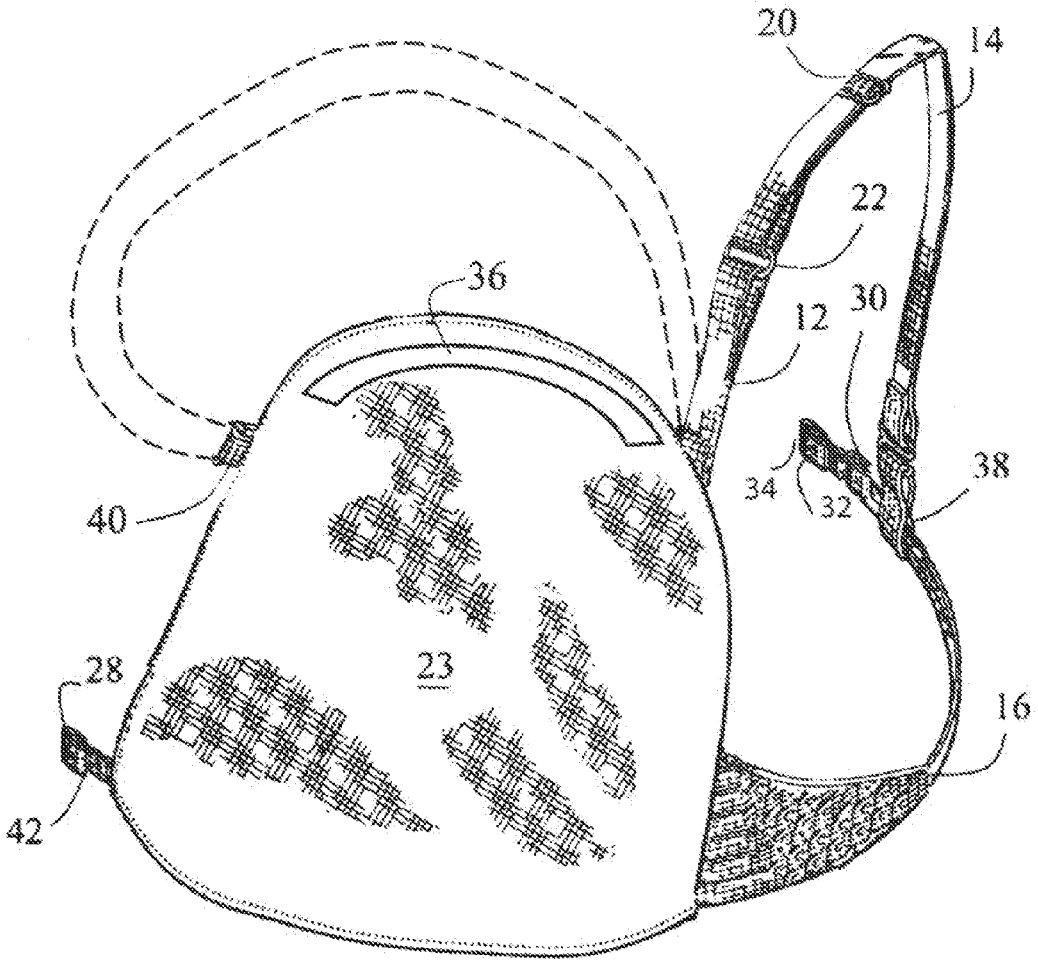
FIG. 2 is a side perspective view of the left cup of a bra, where the right cup of the bra is a mirror image of the left cup in accordance with the principles of the invention.

Referring to FIG. 2, there is shown a side perspective view of the left cup of a bra, where the right cup of the bra is a mirror image of the left cup. The left and right cups of the bra can be separated from each other and each cup of the bra is sized to cover a user's mouth and nose in a relatively air tight manner when the bra cups are used as a face mask. To allow each cup to be used as a separate face mask, the closure clip that connect the two cups together and the closure clip that connect the body straps together can be male and female clips.

In FIG. 2, closure clip 34 on the end of the left body strap 16 can be a male closure clip, and closure clip on the end of the right body strap 16 can be a female closure clip. Referring now to the front closure clip 28, the closure clip on the left cup can be a female clip and the front closure clip on the right cup can be a female clip. Thus, male closure clip 34 on the body strap of the left bra cup can connect to the female closure clip on the body strap of the right bra cup, and it can also connect to the front female clip 28 which is connected to the left bra cup.

It is understood that any known attachment means can be used to connect the straps and bra cups together including, but not limited to buttons, hook and pile fasteners, and hook and loop fasteners or any other method of attachment.

In another embodiment the adjustable shoulder strap 14 is attached to the body strap with a removable fastener 38, and an additional fastener 40 that can connect to the fastener 38 at the end of the shoulder strap is located at or near the top right edge of the left cup 23. When the bra cup is being used as a face mask, fastener 40 at or near the top right edge of the left cup 23 allows a user to move the end of the shoulder strap from the body strap to the clip 40 as is shown in phantom in FIG. 2. This repositioning of the shoulder strap allows a user to use the shoulder bra strap as an additional support point for the mask. With this embodiment a small size bra mask can now be used with a person that has a large size neck by providing an additional adjustable bra mask support around the user's head. This adjustment is not possible with the prior art bra mask identified previously.

In another embodiment a small size chemical and/or radiation detector 42 can be either attached to or located between two layers of fabric of the bra. The detectors can be located adjacent to one side or located on each side of the front closure clip. When the detectors are located on each side of the front closure clip, each bra cup when used as a face mask will have its own detectors. The detectors can be a passive film type of detector which changes color in the presence of radiation, or it can be a detector that triggers an audio signal such as a high pitch sound when exposed to a radiation or toxic environment. To provide an audio signal a miniature speaker and battery can be provided. In place of the audio signal, the detector can be connected to activate a Light Emitting Diode as a indicator that the user was exposed to a dangerous level of radiation or to a specific chemical.

In another embodiment the bra cups, when being used as a face mask, can be stacked where one bra cup is located within the other bra cup. In this embodiment the face mask that has a double thick air filter.

When the bra cup is used as a face mask it must fit tightly around the nasal area of a user to prevent contaminated air from entering the face mask. If the fit is not good around the nasal area, contaminated air which may consist of solid and/or liquid particles, may be inhaled by the user and possibly cause a respiratory condition.

The problem of air leakage around the nasal area often occurs shortly after the mask is first worn. When the fibers of the mask start to fill with particulate matter, the mask offers a greater resistance to air flow which results in a tendency for air to leak around the periphery of the mask, particularly around the bridge of the nose. Unfortunately, the person using the mask is often unaware that unfiltered air is entering the face mask, because the overall resistance to air flow has remained substantially the same.

This air leakage in the nasal area is virtually eliminated with the bra cup here disclosed by placing a small strip of formable material, such as a metal or a plastic which can be bent into a U shape, into the top edge of each bra cup. Referring to FIG. 2, one or more than one strip of narrow formable flexible metal 36 which can be bent into a U shape is located along the top edge of the bra cup. When the bra cup is used as a face mask, the flexible strip(s) of metal will be located over the user's nose bridge area and can be bent into a U shape to provide two or more leg portions which extend along and press on both sides of the user's nose. Thus, by pressing against the user's nose, the strips will cause the mask to provide a more effective seal. Additionally, in order to allow the formable strip(s) to be bent to shape, the strip of formable flexible metal or plastic should be relatively soft and have little memory.

Figure 3:
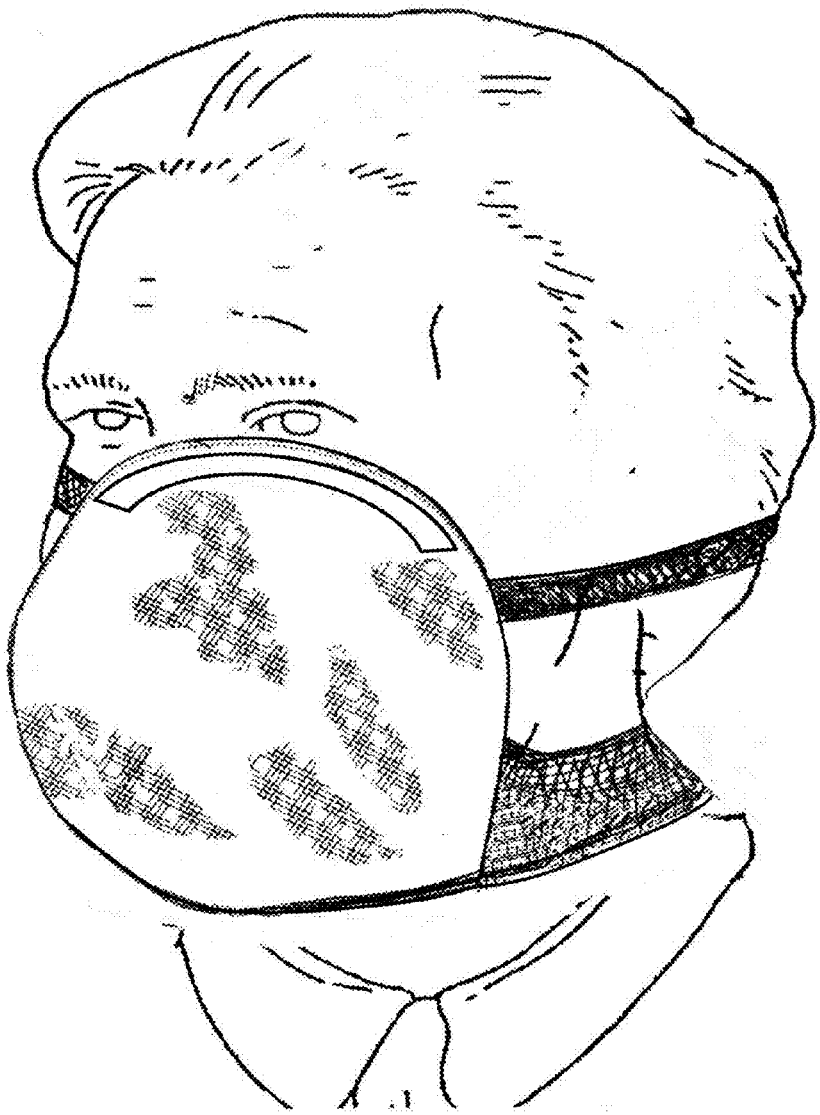
FIG. 3 is a front perspective view of the left cup portion of the bra of FIG. 2 being used as a face mask in accordance with the principles of the invention.

FIG. 3 shows the left bra cup being used as a face mask in accordance with the principles of the invention.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings.

The embodiments discussed were chosen and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are entitled.

What is claimed is:

1. A bra that is adapted to be a face mask comprising:

a first bra cup removably coupled to a second bra cup with a first attachment means;

wherein each bra cup includes an air filter;

a formable member coupled to the air filter of each bra cup;

a first body strap having one end coupled to the first bra cup and a second end:

a second body strap having one end coupled to the second bra cup and a second end;

a second attachment means for removably coupling the second ends of the first and second body straps together;

wherein said second attachment means is adapted to couple said first body strap to said second body strap or to couple said first body strap to said first bra cup via the first attachment means when said first bra cup is separated from the second bra cup;

wherein an air contamination detector is attached to or near at least one of said bra cups.

2. The bra of claim 1 wherein said air contamination detector is a radiation level detector.

3. The bra of claim 1 wherein said air contamination detector is a smoke or chemical vapor detector.

4. The bra of claim 1 wherein said air contamination detector is coupled to an audio alarm device or a visual alarm device.

5. The bra of claim 4 wherein said visual alarm device is a Light Emitting Diode.

* * * * *